United States Patent [19]

Juenkersfeld et al.

[11] Patent Number: 4,750,531

[45] Date of Patent: Jun. 14, 1988

[54] METHOD AND APPARATUS FOR REPLACING CELLULAR PANELS USED IN CONTAINER FILLING MACHINES

[75] Inventors: Harald Juenkersfeld, Wuppertal; Georg Fischer, Velbert; Lutz Langenhahn; Wilhelm Berden, both of Duesseldorf, all of Fed. Rep. of Germany

[73] Assignee: Benz & Hilgers GmbH, Duesseldorf, Fed. Rep. of Germany

[21] Appl. No.: 926,931

[22] Filed: Nov. 3, 1986

[30] Foreign Application Priority Data

Nov. 2, 1985 [DE] Fed. Rep. of Germany ..... 3538993
Jun. 5, 1986 [DE] Fed. Rep. of Germany ..... 3618971

[51] Int. Cl.[4] ..... B65B 3/04

[52] U.S. Cl. ..... 141/1; 141/84; 141/98; 141/99

[58] Field of Search ..... 141/1–12, 141/14–27, 98, 99, 250–284, 84, 367, 368

[56] References Cited

U.S. PATENT DOCUMENTS 3,911,976 10/1975 Rosen ..... 141/84
3,965,656 6/1976 Gerben ..... 53/282

*Primary Examiner*—Houston S. Bell, Jr.
*Attorney, Agent, or Firm*—Klein and Vibber

[57] ABSTRACT

An automatic exchange device for format dependent cellular panels used in container-filling machines for filling containers with foodstuffs, flavorings or other liquid to pastiform products, the machines being arranged to pick-up and transport the containers whereby cellular panels are arranged adjacent to each other on a through-conveyor or periodically circulating conveyor and are corrected to the conveyor. A replacement mechanism for the cellular panels. The exchange of panels is effected with the assistance of a manipulator, which automatically detaches the connection with the assistance of a motor driven screw tool and also reattaches the connection after the exchange. After releasing the connection, the manipulator picks up the cellular panel by means of suction cups and removes it via the use of an elevator into a magazine, which, for example, is comprised of a drum with radially arranged partitions. However, before the cellular panel can be deposited in the drum, a new cellular panel must be taken out of the partition of the drum by means of a gripper. Subsequent to the interchange of positions of the cellular panels in the drum, the new cellular panel is carried to the manipulator by means of the elevator. The manipulator, then, picks up the cellular panel and places it in the container-filling machine. Here, the new cellular panel is screwed to the chains of the conveyor by means of the screw tool.

44 Claims, 7 Drawing Sheets

2
19

5
6
7
8
9
15
3
4
13,14
11
24
10
12
1

18
4
15
11
13
14
15
12
1

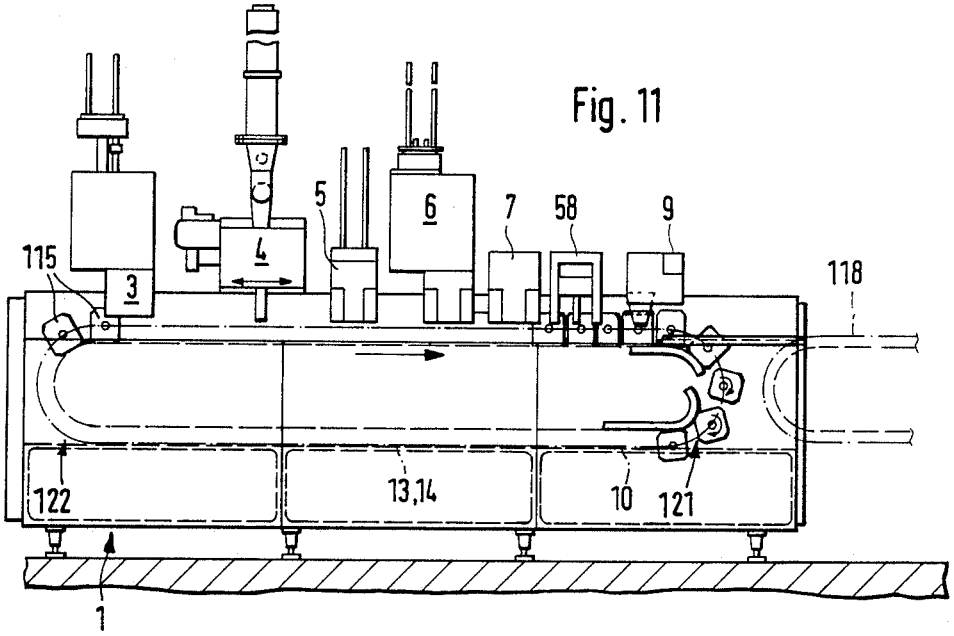
Fig. 11
Fig. 12
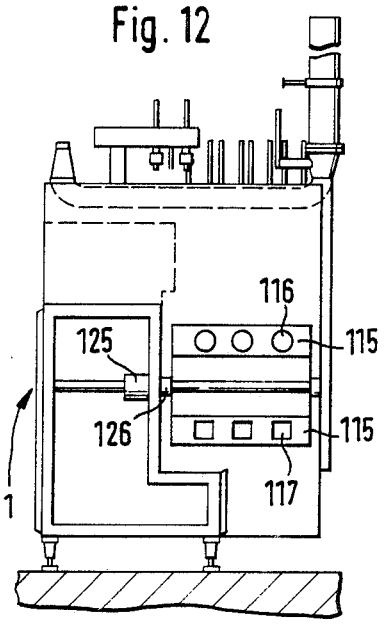
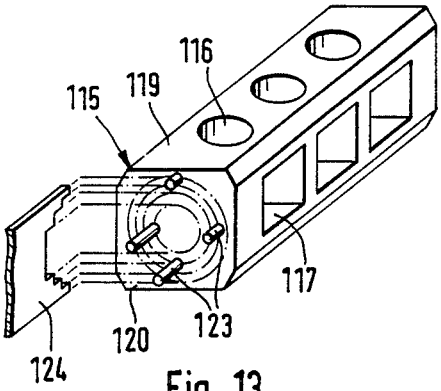
Fig. 13

METHOD AND APPARATUS FOR REPLACING CELLULAR PANELS USED IN CONTAINER FILLING MACHINES

BACKGROUND OF THE INVENTION

The invention relates to a method for replacing format dependent cellular panels used in container-filling machines for filling containers with foodstuffs, flavorings as well as other liquid or pastiform products. The machines of this type are generally arranged to pick up and transport containers, whereby the cellular panels are arranged adjacent to each other on a through-conveyor or periodically circulating conveyor and are thereby connected to the conveyor with means for replacement.

Present day container-filling machines are not utilized for filling one product alone, but rather numerous fluid or pastiform foodstuffs and flavorings. Due to this large number, there arises a requirement for various container forms and sizes. Consequently, the conveyor which runs through the filling machine carries cellular panels which are arranged in rows across the direction of transportation. These cullular panels are equipped with container pick-ups appropriate to the container for filling. Whilst the container's external dimensions are always the same, during one filling operation, the container pick-ups must always correspond with the relevant container sizes, and consequently the cellular panels have to be changed with each alteration of the product. Furthermore, for product or format alteration, all work stations also must be converted in addition to the changing of the cellular panels.

Due to the considerable time required for the conversion of the container-filling machine as a whole, the practice hitherto has been, in particular for the exchange of cellular plates, to detail an additional employee to perform the following operations under the most arduous conditions: to detach the screw connections connected to the two conveying chains arranged on both narrow sides of the cellular panels; to remove the old cellular panel and to replace it with a new one; and finally reattaching the screw connection. The mere exchange of these cellular panels takes approximately one hour. It should also be taken into account that the space available between the individual work stations is dimensioned to very close tolerances and that, due to the relatively great depth involved (four containers adjacent to each other), it may be very laborious to gain access to the furthermost bolt. Amongst these laborious conditions: the freshly installed cellular panels also have to be realigned such that the cellular panels—which also fulfill the function of pressure pads for the sealing tool—arrive at the sealing station at an accurate position relative to the same. A particular disadvantage of cellular panels which have to be laboriously manually exchanged is that after repeated removal and re-attachment, the aluminum cellular panels, which possess surface protection against corrosion, suffer damage due to handling by tools. As long as the occurrence of such damage is restricted to the area of the screwed connection, the damage is tolerable. It is a different matter if the edges of the container pick-ups also suffer damage. Damage of this kind means that correct sealing can no longer be achieved and consequently he preservability of the filled product is greatly reduced and, therefore, production has to be stopped. Damage relating to container pick-ups also applies in the case of the utilization of stainless materials, e.g. V2A, for the construction of the cellular panels.

SUMMARY OF THE INVENTION

According to the purpose underlying the invention, the old cellular panels, in the context of the container filling machine described at the outset, can be rapidly and reliably replaced by fresh cellular panels, during which operation the fresh cellular panels must be accurately aligned.

The advantages achieved by preferred embodiments of the invention consist in particular of potential reduction of exchange time to approximately 10 minutes, due to automation. The features of mechanical pick-up by suction cups and the introduction of cellular panels to the machine further give the advantage that each cellular panel can be inserted in an exactly reproducible position.

Furthermore, in another desirable embodiment the breaking or making of a screwed connection by the mechanical aid of a motorized screw-tool prevents any damage to the cellular panel. It is furthermore advantageous that due to the arrangement of a manipulator together with a magazine (with fresh cellular panels) on a separate trolley after exchange of the magazine (with cellular panels of another format), various container-filling machines can be converted consecutively. A further result of this is that existing machines can be automated without high investment, at least in connection with the range of cellular panels for format conversion. Use of a drum, too, exhibits advantages in that its magazine layout provides a compact form of design with a low space requirement, so that little space is required for the storage of the widest variety of cellular panels which can remain in an exchangeable drum.

An even better solution may be obtained if various container pick-ups are simply rotated to a filling position. For this purpose, the container cells are suitably made as cell rotors equipped with the various container pick-ups.

The advantages thus obtained are in particular that exchange time has been virtually reduced to the period required for one pass by the conveyor. Furthermore, all alignment and fixing operations are dispensed with, since according to the construction of the appliance an accurately reproducible position of individual cell sides is ensured at every position of the cell rotors.

A further major advantage is that external magazines for storage of the cellular panels, as used in the older generation of technology, are dispensed with, since in the new form several cellular panels are simultaneously housed in one cellular rotor and are directly stored in the machine.

BRIEF DESCRIPTION OF THE DRAWINGS

These and other objects, features and advantages of the present invention will become more obvious from the following description when taken in connection with the accompanying drawings, in which:

FIG. 11 illustrates a side view of a container-filling machine, FIG. 12 illustrates a left-hand front view of the container-filling machine as per FIG. 11, and FIG. 13 illustrates a perspective view of a cellular rotor.

DETAILED DESCRIPTION

Figure 1:
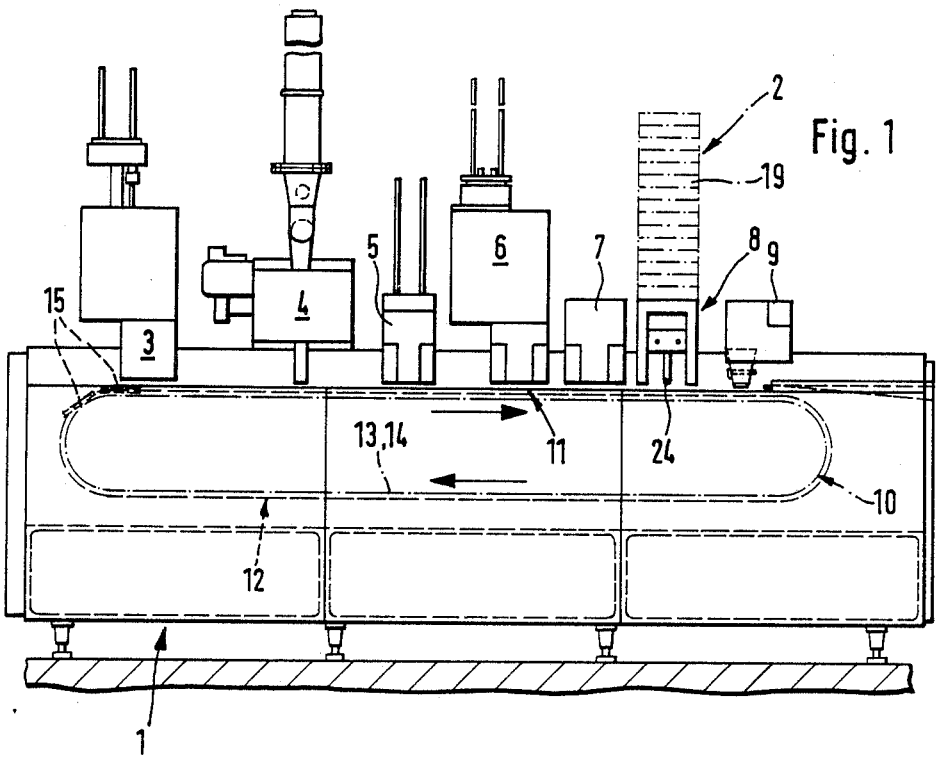
FIGS. 1 and 2 illustrate a side view and front view respectively of a container-filling machine.

FIG. 1 illustrates a container-filling machine which is equipped with the following work stations, shown from left to right in the transportation sequence:

Container feeder station 3, filling station 4, lid station 5, sealing station 7, cellular panel-exchanger 8 and lift-out station 9. Below these stations there is a circulating conveyor 10 which rotates clockwise. Conveyor 10 is split up into two levels, whereby the upper level below the work stations is designated operating level 11 and the lower level is designated return level 12. Normally this conveyor 10 consists of two chains 13, 14 which run parallel to each other and are mounted between cellular panels 15. These cellular panels 15 possess apertures known as container pick-ups 16, 17 (see FIG. 9), in which there are inserted containers made of, for example, plastics material, cardboard, paper, glass, sheet metal. During forward movement of conveyor 10, the containers are moved from left to right, according to the direction of transportation, by container-filling machine 1, whilst being consecutively moved past in sequence below work stations 3–9.

The invention centers on the region of container-filling machine 1 in which there is located cellular panel-exchanger 8.

FIG. 1 is mainly intended to refer to an embodiment whereby a magazine 2 is arranged in the form of a stacking shaft 19 above cellular panel-exchanger 8. An appliance of this kind is stationary and is incorporated in the machine. Nevertheless, in order for such an exchanger system to achieve universal application, an appliance of this type must be made in mobile form such that a single appliance can be used for servicing various filling machines one after another.

Figure 2:
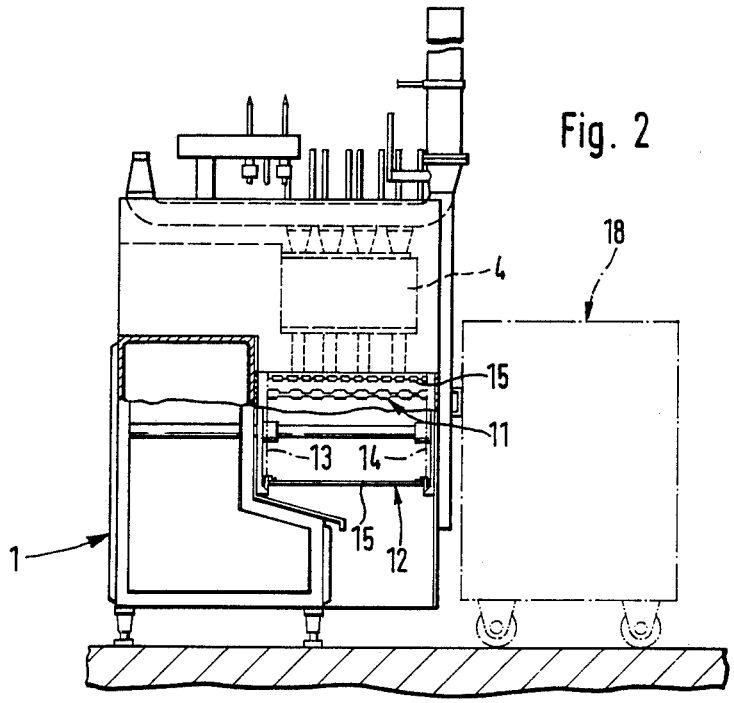

The various appliances illustrated and described in FIGS. 3–9 for the exchange of cellular panels 15 relate to various forms of mobile exchange trolleys 18 of the type which are run adjacent to the tank filling machine 1 (shown cross-hatched in FIG. 2).

In addition to exchange trolley 18, FIG. 2 also illustrates conveyor 10 in the direction of operation (for operating-level 11) as well as filling station 4.

Figure 3:
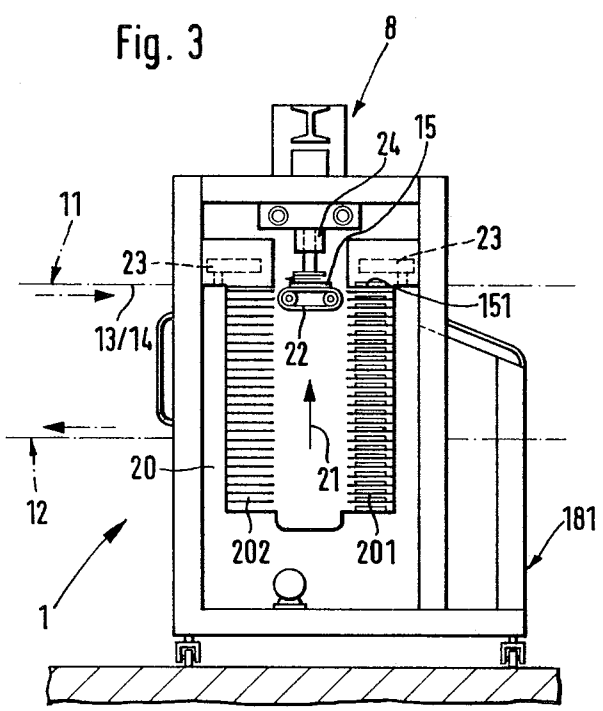
FIG. 3 illustrates a side view of a cellular panel-exchange trolley with a magazine in the form of a double shaft.

FIG. 3 illustrates an initial variant of exchange trolley 18 (as per FIG. 2), in this instance designated 181. This exchange trolley 181, for example, possesses a double shaft 20, whose right-hand shaft 201 carries the new cellular panels 151 which possess another form of container pick-up. Left hand shaft 202, on the other hand, which can house the old or initial-format cellular panels 15, is empty. This double shaft 20 can be run upwards in accordance with the direction of arrow 21, so that in each case the next partition of double shaft 20 for emptying or filling comes to rest at the upper compartment of belt 22 such that the old cellular panel 15 deposited by manipulator 24 of cellular panel exchanger 8 can be fed into the empty partition of double shaft 20. A slide 23 then slides a fresh cellular panel 151 out of full stacking shaft 201 and onto belt 22, from which this fresh cellular panel 151 can then be picked up by manipulator 24 and fed into filling machine 1. (The detachment/attachment of cellular panels 15/151 is described in FIG. 10.) It should also be mentioned that the exchange procedure, and thus the individual movement of manipulator 24 and of double shaft 20, are carried out according to the rate of operation of filling machine 1, i.e. the rate of operation of the said machine is utilized for determining the movement of conveyor 10 for the intermittent exchange procedure.

Figure 4:
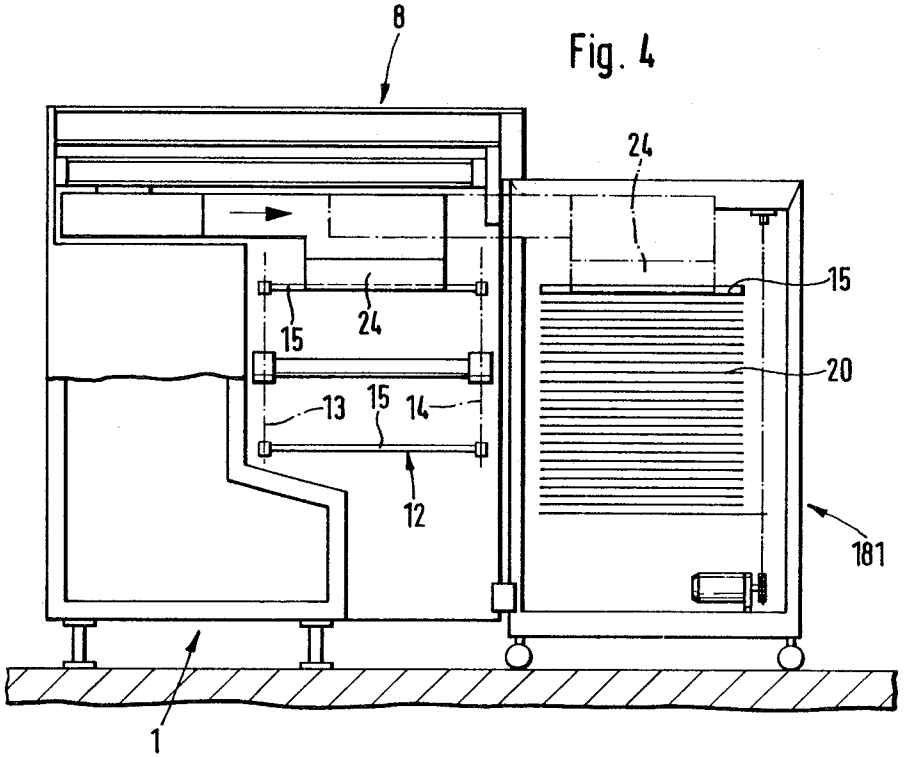
FIG. 4 illustrates a front view of a container-filling machine in combination with the exchange trolley as per FIG. 3.

In FIG. 4, a view according to the direction of operation, i.e. a front view of filling machine 1, an exchange trolley 181 coupled with filling machine 1 is illustrated. In particular, it illustrates cellular panel exchanger 8 with manipulator 24 in two positions. Whilst the left-hand position, for example, illustrates the picking-up of old cellular panel 15 from chains 13 and 14, the right-hand diagram, shown in dot-dash form, illustrates the depositing of old cellular panel 15 on belt 22, which is not illustrated here. The position of this panel exchanger 8 is also permanent, i.e. it is directly incorporated in the machine. By mounting this cellular panel-exchanger 8 on exchange trolley 181, the cellular panel-exchanger is—as mentioned above—useable universally for various container-filling machines. It should also be mentioned that arrangements have been made for power supply, for example pneumatic and electrical, to be provided from container filling machine 1, when exchange trolley 181 is coupled to filling machine 1. The same applies to the control of individual movements in the area of double shaft 20. The facility for this power/control coupling between exchange trolley 181 and container-filling machine 1 is common to all other variants described below.

Figure 5:
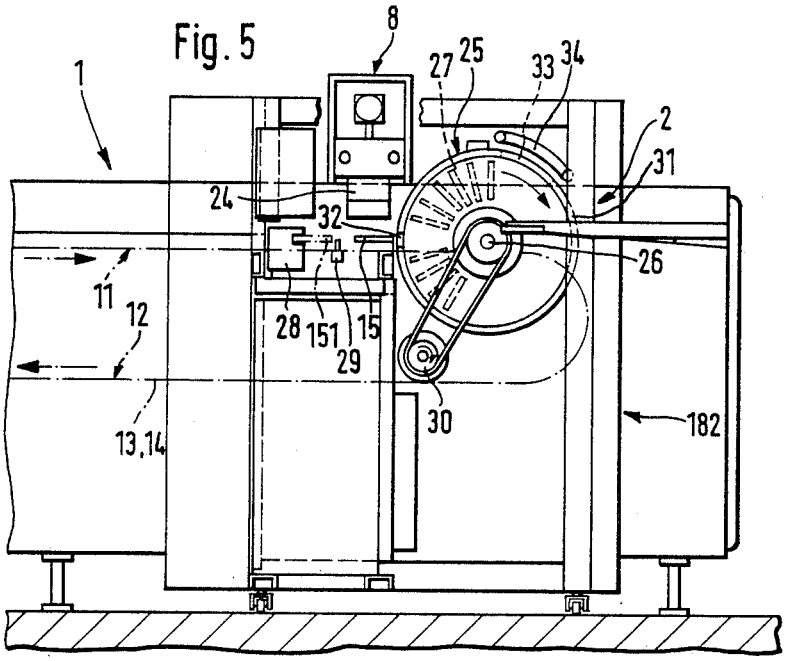
FIG. 5 illustrates a side view of a cellular panel-exchange trolley in another embodiment, with a magazine made in the form of a drum.

FIG. 5 illustrates another embodiment of exchange trolley 18 (as per FIG. 2), which in this instance is designated 182. Another view of the embodiment shown in this instance is illustrated, in perspective, in FIG. 9. Only the casing of drum 25 has been omitted. The main difference relative to the preceding embodiment is that the use of a drum 25 has now been adapted for magazine 2. This drum 25 has been arranged such that axis of rotation 26 is only slightly above operating level 11, and such that the removal of fresh cellular panels 151 from the radially arranged partitions 27 of drum 25 can be most quickly achieved by gripper 28; while the insertion of old cellular panel 15 into previously vacated partition 27 can also be achieved by the quickest means, i.e. slide 29. The drum possesses the most compact form possible relative to a stacking shaft, and consequently such drums are also very suitable, together with cellular panels 15 taken out of exchange trolley 181, for exchange with a fresh drum possessing cellular panels in other formats. Permanent storage is substantially facilitated by this drum. The process for exchange of cellular panels 15/151 between container-filling machine 1 and exchange trolley 182, using manipulator 24, is carried out in the same way as described above in the procedure for exchange utilized with the exchange trolley shown in FIG. 3. The main difference inherent in this embodiment is in connection with the compact form of drum and particularly in that fresh cellular panel 151 is initially extracted from the drum partition and removed from drum 25 to the point where an old cellular panel can be deposited by manipulator 24 between new cellular panel 151 and drum 25.

Simultaneously, by means of combined forward movement of slide 29 and gripper 28, old cellular panel 15 is inserted into empty drum partition 27 and fresh cellular panel 151 is brought to the pick-up position below manipulator 24 which picks up this fresh cellular panel 151 and then transports it into container-filling machine 1.

Drum 25, in addition to drive 30, is also equipped with a casing 31 which essentially has only two apertures. One aperture 32 fulfills the above-described function of automatic removal/filling by gripper 28/slide 29, and the other aperture 33 fulfills the function of manual exchange of the cellular panels deposited in the drum, where this is necessary. Furthermore, aperture 33 can be sealed by cover 34.

Figure 6:
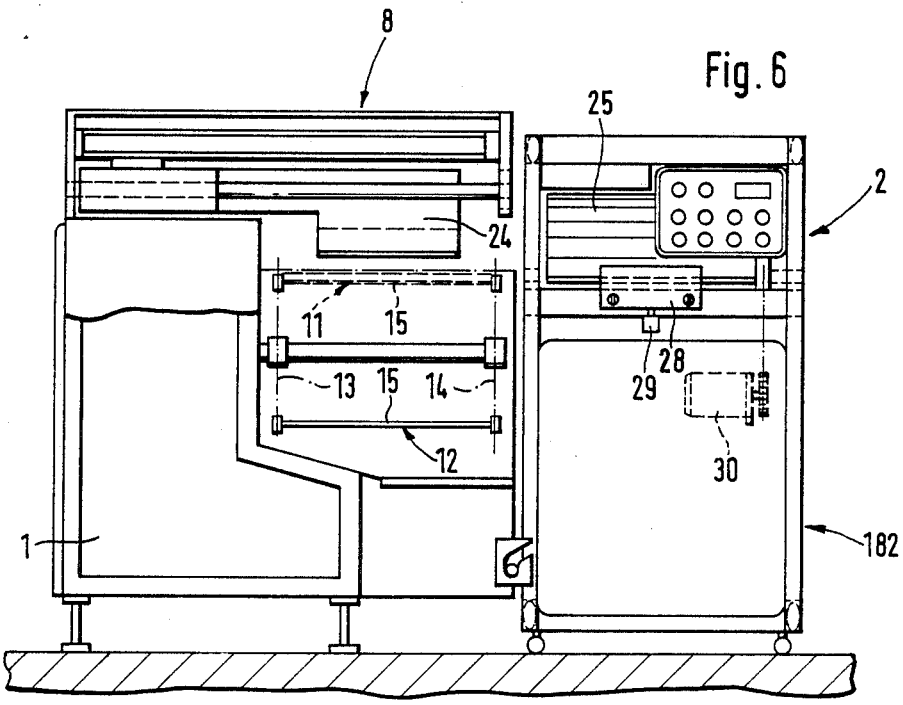
FIG. 6 illustrates a front view of a container-filling machine in combination with the trolley as per FIG. 5.

FIG. 6 illustrates exchange trolley 181 in its position when run up to tank filling machine 1, and the mechanical coupling to the machine. In this case, too, cellular panel-exchanger 8 is arranged, together with manipulator 24, permanently in container-filling machine 1. The instance is also covered by the above description relating to FIGS. 3 and 4, whereby cellular panel-exchanger 8 can also be installed on exchange trolley 182.

Figure 7:
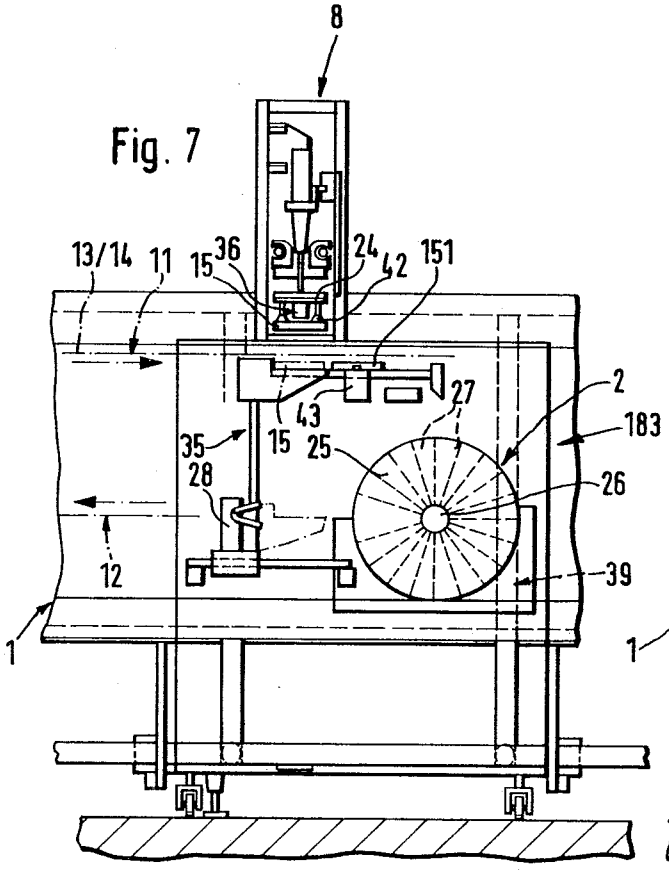
FIG. 7 illustrates a side view of the trolley as per FIG. 5 in another embodiment.
Figure 9:
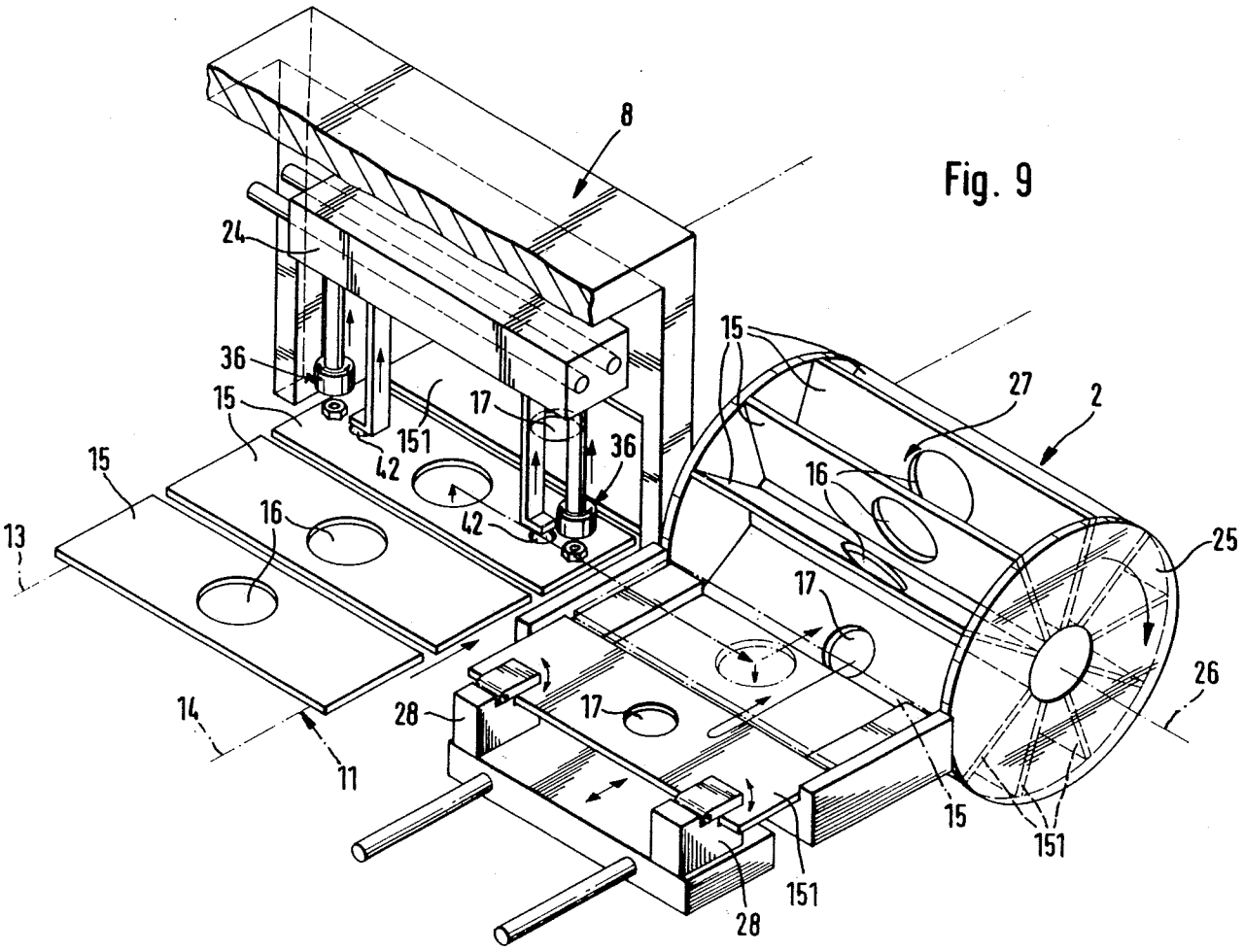
FIG. 9 illustrates a perspective view of an automatic cellular panel-exchange system as per FIG. 5.

FIGS. 7 and 9 illustrate an exchange trolley 183 of the same type as described in FIGS. 5 and 6, but with the distinction that the main load—i.e. drum 25—has been arranged in a much lower position in order to eliminate top-heavy loading of exchange trolley 182, (as per FIGS. 5 and 6). However, in order to provide for the same function, there is envisaged an elevator 35 which runs between operating level 11 and the level which is parallel with it and through which there runs axis of rotation 26. The process of exchange of cellular panels 15/151 in the vicinity of drum 25 is identical with the exchange process as described in the embodiment relating to FIG. 5, except that the preparation for pick-up of fresh cellular panel 151 and depositing of old cellular panel 15 by manipulator 24 has been altered by the lowering of the position of drum 25. There is no delay associated with this embodiment, because the raising and lowering of elevator 35 always occurs during the period during which screw tools are breaking-/making the connections between chains 13 and 14 and cellular panels 15 and 151.

In the top position of elevator 35, fresh cellular panel 151 is drawn sideways by slide 43 so that old cellular panel 15 can be deposited on elevator 35. After elevator 35 has begun the lowering movement and has completed just over one panel's thickness of movement, slide 43 slides the fresh cellular panel 151 back into the initial position, i.e. into the pick-up position underneath manipulator 24.

Figure 8:
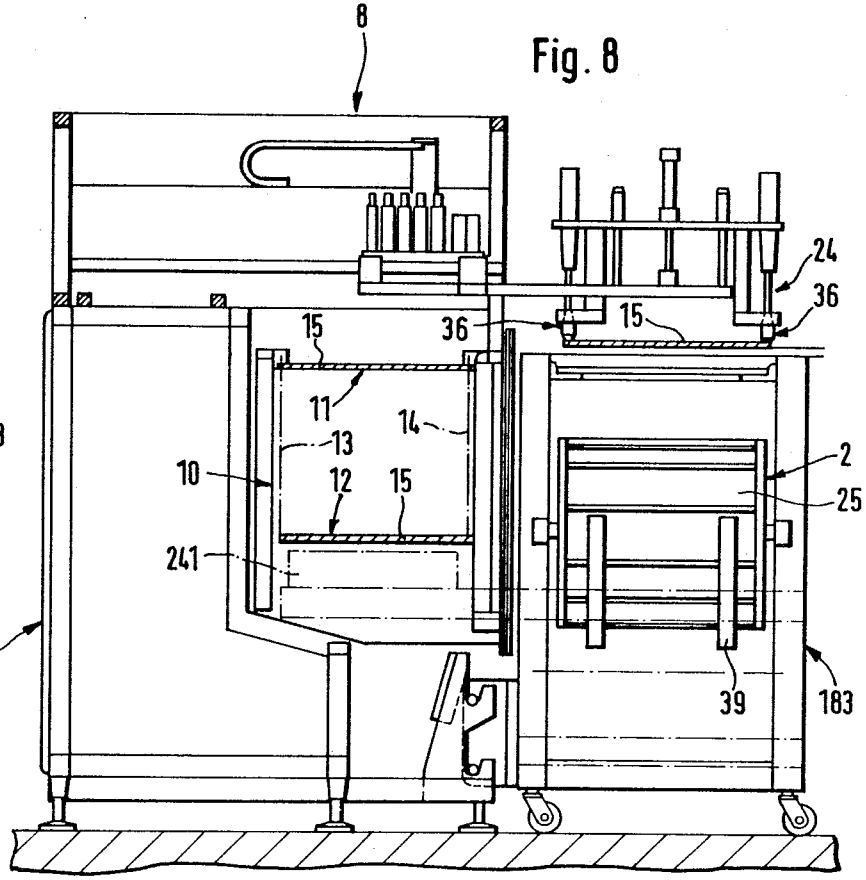
FIG. 8 illustrates a front view of a container-filling machine in combination with the trolley as per FIG. 7.

FIG. 8 illustrates, in hatched form, a further variant for the arrangement of the manipulator, where manipulator 241 is arranged such that it can be run underneath return level 12 into container-filling machine 1 from exchange trolley 183, with the connections between chains 13, 14 and cellular panels 15 being detached from underneath. Next, cellular panels 15 are lowered and conveyed into exchange trolley 183 as already described. After the familiar process of cellular panel exchange within exchange trolley 183, fresh cellular panels 151 are conveyed back into the container-filling machine and raised from below to return level 12. Next, the connections between chains 13, 14 and fresh cellular panel 151 are restored. By this means top-heaviness in trolley 183 is avoided and furthermore a vacant space is made available, i.e. it is not necessary to provide, in the vicinity of work stations 2–9, extra space for cellular panel exchange.

Figure 10:
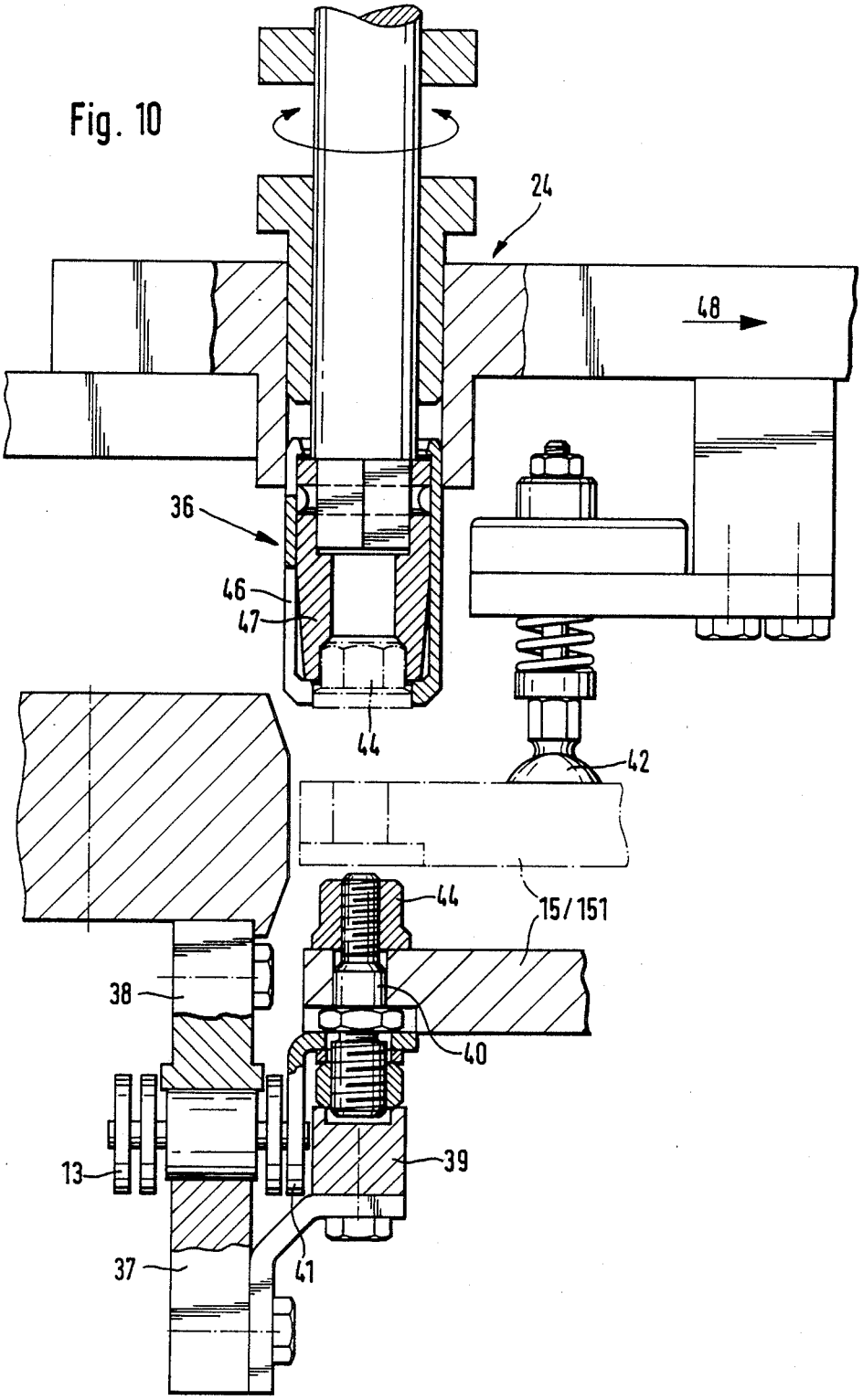
FIG. 10 illustrates in section a screw toll and a clamp unit in an operating position.

FIG. 10 illustrates the area of connection between chain 13 and cellular panel 15. Upper and lower chain guides 37, 38 are provided for accurate guidance of the chain. Furthermore a support rail 39 is arranged in the vicinity of manipulator 24 in order firstly to hold alignment bolts 40 in the alignment position at such time as cellular panels 15 are absent (in the interests of facilitating insertion of fresh cellular panel 151) and secondly in order to take up the load exerted by the screw tool on the chain, in particular on bracket 41. For purposes of exchanging cellular panels, suction cup 42 and screw tool 36 are successively attached onto cellular panel 15 for removal. After activation of screw tool 36, collar nut 44 is released by slotted clamp 46 which surrounds bolthead 47 and is then clamped and raised. Next, suction cups 42—which have in the meantime been activated—raise cellular panel 15 to a point above alignment bolt 40. Next, the whole unit is raised by manipulator 24 out of container-filling machine 1 in accordance with arrow 48 in order for cellular panel 15 to be replaced, as described in further detail above, by a fresh cellular panel 151 in the magazine 2. After fresh cellular panel 151 has been run into the position indicated by hatching, the procedure continues in reverse: firstly, fresh cellular panel 151 is lowered onto the alignment bolt 40 and deposited on bracket 41 of chain 13, after which screw tool 36 is lowered and collar nut 44 is screwed onto alignment bolt 40. It should now be indicated that controlled movements enable each cellular panel 151 to be laid exactly at the position of cellular panel 15 which has previously been removed, thus obviating the need for additional alignment of fresh cellular panels 151.

FIG. 11 illustrates a container-filling machine 1 which largely corresponds to FIG. 1; This shows—again in the left-to-right direction of transportation: container feeder station 3, filling station, 4, lid station 5, lid distributor 6, sealing station 7, check station 8 and lift-out station 9. Below these stations there is located a recirculating conveyor 10 which rotates clockwise. This conveyor 10 consists of two chains 13, 14 guided parallel and adjacent to each other and carrying cellular rotors 115 between them. These cellular rotors 115 possess apertures—container pick-ups 116, 117 (Cf. FIG. 13)—in which are inserted containers which are to be filled and which are made of, for instance, plastics, card, paper, glass or sheet metal. During forward movement of conveyor 10, the containers are moved by container-filling machine 1 from left to right in accordance with the direction of transportation, and are successively carried past and underneath work stations 3–7, 58 and 9. Next, the containers are taken over by an outward conveyor 118 and brought to a packing machine, which is not illustrated.

In the event that a container of a new type should need to be filled, cellular rotors 115—after lifting-out of containers at the right-hand curve of conveyor 10—are rotated until an outwards-facing position is taken up by the cell side whose container pick-up corresponds to the type of container which is next to be filled. Since each cellular rotor 115 possesses several cell sides 119, it is feasible either to provide a fixed-position rotary drive 125 which can be coupled by coupling 126 with each cellular rotor 115 or for front surfaces 120 of cellular rotor 115 to be fitted, for example, with indexed pins 123 which make it possible for the cellular rotors to be rotated, during movement, in stages by fixed-position stops 124 arranged laterally and adjacent to chains 13, 14, until the desired cell side is facing outward. This means that both counter-clockwise and clockwise rotation of cellular rotor 115 is possible. If right-hand reversal point 121 of conveyor 10 should not be adequate, then one further rotation of cellular rotor 115 at left-hand reversal point 122 may be performed.

Although a limited number of embodiments of the invention have been illustrated in the accompanying drawings and described in the foregoing specification, it is to be especially understood that various changes, such as in the relative dimensions of the parts, materials used, and the like, as well as the suggested manner of use of the apparatus of the invention, may be made therein without departing from the spirit and scope of the invention, as will now be apparent to those skilled in the art.

We claim:

1. A method for replacing cellular panels used in container-filling machines for filling containers with foodstuffs, flavorings or other liquid or pastiform products, wherein containers are arranged to be picked up and transported, whereby the cellular panels are arranged adjacent to each other on a through-conveyor or periodically circulating conveyor and are connected to the conveyor with means for replacement of the cellular panels, the method comprising the following automatically operating steps:

(a) powered release of the connection between a first relevant cellular panel, adapted for a first mode of operation of the conveyor;
(b) pick-up of the first cellular panel thereby released,
(c) transport of the released first cellular panel away from the operating region and deposit in a vacant compartment outside the area of movement of the cellular panels;
(d) pick-up of a second cellular panel adopted for a second mode of operation;
(e) bringing the second cellular panel into the area of movement of the conveyor; and
(f) depositing the second cellular panel on the conveyor at the site of the first cellular panel previously removed and connecting the second cellular panel to the conveyor.

2. An apparatus for carrying out the method as set forth in claim 1 for container-filling machines for filling containers with foodstuffs, flavorings or other liquid or pastiform products, which includes a recirculating conveyor adapted to carry detachable cellular panels, to be arranged in rows across the direction of transport, for the purpose of picking up said containers, the conveyor causing the panels to be movable past work stations which are continuous or successively staged depending upon the required cycle of operations, the cycle of operations including a container-feeding station, a container-filling station, and a container-sealing station, space being provided between at least two adjacent work stations for replacement of cellular panels, a cellular panel manipulation which is retractable into a vacant space between at least two work stations, a motorized tool which alternately breaks/makes the connection between cellular panels and the conveyor, means for picking up and holding cellular panels for replacement; and a magazine for cellular plates which have been replaced by fresh cellular plates.

3. An apparatus for carrying out the method as set forth in claim 1 for container-filling machines for filling containers with foodstuffs, flavorings or other liquid or pastiform products, which includes a recirculating conveyor adapted to carry detachable cellular panels, to be arranged in rows across the direction of transport, for the purpose of picking up the said containers, the conveyor causing the panels, by means of an upper conveying level which is the operating level, to be movable past work stations which are transported through or which follow each other in a sequence depending upon the required cycle of operations, the cycle of operations including a container-feeder station, a container-filling station, and a container-sealing station, and causing the panels, by means of a lower conveying level which is the return level, to be moved back, after removal of the filed containers, a cellular panel manipulator which is retractable below the lower transport level, a motorized tool which alternately breaks/makes the downwardly directed connection between cellular panels and the conveyor, means for housing or folding cellular panels for replacement, and a magazine for cellular plates which have been replaced by fresh cellular plates.

4. An apparatus according to claim 2, wherein the motorized tool includes a bolthead and the means for holding cellular panels for replacement comprises suction cups.

5. An apparatus according to claim 4, wherein the magazine comprises a stacking shaft provided with partitions for housing cellular panels.

6. An apparatus according to claim 5, wherein the magazine comprises a double shaft, with two stacking shafts arranged parallel to each other, one stacking shaft serving to pick-up old cellular panels and the other stacking shaft serving to provide the site for removal of fresh cellular panels.

7. An apparatus according to claim 6, wherein the stacking shaft is located outside the container-filling machine and is the vicinity of the cellular panel manipulator.

8. An apparatus according to claim 7, wherein the magazine is located adjacent to the container-filling machine and in the vicinity of a cellular panel exchanger.

9. An apparatus according to claim 8, wherein the magazine comprises a drum whose axis of rotation is adapted to be horizontal, and radially arranged partitions for picking up cellular panels.

10. An apparatus according to claim 9, which includes a peripherally arranged support rail for the lower half of the drum.

11. An apparatus according to claim 10, wherein the drum is situated with its axis of rotation approximately in the vicinity of the operating level of the conveyor.

12. An apparatus according to claim 11, wherein the drum is located significantly below the operating level of the conveyor and with its axis of rotation level with the return level of cellular panels.

13. An apparatus according to claim 12, which includes an elevator to arrange for the cellular panels to be changed over, the said elevator adapted to run mostly tangential to the circumference of the drum.

14. An apparatus according to claim 13, wherein the elevator extends between the operating level of the conveyor and the said return level of the conveyor.

15. An apparatus according to claim 14, which includes an extraction/insertion device arranged between the magazine and an end stop of the manipulator, in the region of the magazine, the extraction/insertion device being adapted for extraction/insertion of the fresh/old cellular panels from or into the relevant magazine partition.

16. An apparatus according to claim 15, which includes a sliding device for the cellular panels for exchange located between the drum and the lowest position of the elevator.

17. An apparatus according to claim 16, wherein the sliding device is in the form of a sliding gripper activatable by a controlled operating jack or the like.

18. An apparatus according to claim 17, wherein the sliding device is a slide retractable into the drum.

19. An apparatus according to claim 18, wherein the magazine and cellular panel charger are located on a mobile trolley.

20. A method for replacing cellular panels used in container-filling machines for filling containers with foodstuffs, flavorings or other liquid or pastiform products, the machines being arranged to pick-up and transport said containers whereby the cellular panels are arranged adjacent to each other on a through-conveyor or periodically circulating conveyor and are connected to the conveyor with means for replacement of the cellular panels, the method including rotating to the filling position container compartment pick-ups appropriate to the said containers for refilling.

21. An apparatus for carrying out the method claimed in claim 20 used in container-filling machines for filling containers with foodstuffs, flavorings or other liquid or pastiform products, which apparatus includes a recirculating conveyor adapted to carry detachable cellular panels, to be arranged in rows across the direction of transport, for the purpose of picking up the said containers, the conveyor causing the panels to be movable past work stations which are continuous or successively staged depending upon the required cycle of operations, the cycle of operations including a container-feeder station, a container-filling station, a container-sealing station, space being provided between at least two adjacent work stations for replacement of cellular panels, and rotatable cellular rotors in whose periphery container pick-ups are provided.

22. An apparatus according to claim 21, wherein said cellular rotor is in the form of a column whose axis of rotation is transverse to the direction of transportation and is provided with container pick-ups on each cell side.

23. An apparatus according to claim 22, wherein each cellular rotor has at least three, preferably four, cell sides.

24. An apparatus according to claim 23, wherein adjacent sides of each cellular rotor has cup pick-ups for various cup formats.

25. An apparatus according to claim 24, wherein the cellular rotors have indexed drive pins on their end surfaces.

26. An apparatus according to claim 25, wherein the said cellular rotor has on an end surface an engageable/-disengageable coupling for a rotary drive.

27. An apparatus according to claim 26, wherein said cellular rotor is a relatively lightweight construction in the form of a plastics material or metal laminate.

28. An apparatus according to claim 3, wherein the motorized tool includes a bolthead and the means for holding cellular panels for replacement comprises suction cups.

29. An apparatus according to claim 28, wherein the motorized tool includes a bolthead and the means for holding cellular panels for replacement comprises suction cups.

30. An apparatus according to claim 29, wherein the magazine comprises a stacking shaft provided with partitions for housing cellular panels.

31. An apparatus according to claim 30, wherein the magazine comprises a double shaft, with two stacking shafts arranged parallel to each other, one stacking shaft serving to pick-up old cellular panels and the other stacking shaft serving to provide the site for removal of fresh cellular panels.

32. An apparatus according to claim 31, wherein the stacking shaft is located outside the container-filling machine and in the vicinity of the cellular panel manipulator.

33. An apparatus according to claim 32, wherein the magazine is located adjacent to the container-filling machine and in the vicinity of a cellular panel exchanger.

34. An apparatus according to claim 33, wherein the magazine comprises a drum whose axis of rotation is adapted to be horizontal, and radially arranged partitions for picking up cellular panels.

35. An apparatus according to claim 34, which includes a peripherally arranged support rail for the lower half of the drum.

36. An apparatus according to claim 35, wherein the drum is situated with its axis of rotation approximately in the vicinity of the operating level of the conveyor.

37. An apparatus according to claim 36, wherein the drum is located significantly below the operating level of the conveyor and with its axis of rotation level with the return level of cellular panels.

38. An apparatus according to claim 37, which includes an elevator to arrange for the cellular panels to be changed over, the said elevator adapted to run mostly tangential to the circumference of the drum.

39. An apparatus according to claim 38, wherein the elevator extends between the operating level of the conveyor and the said return level of the conveyor.

40. An apparatus according to claim 39, which includes an extraction/insertion device arranged between the magazine and an end stop of the manipulator, in the region of the magazine, the extraction/insertion device being adapted for extraction/insertion of the fresh/old cellular panels from or into the relevant magazine partition.

41. An apparatus according to claim 40, which includes a sliding device for the cellular panels for exchange located between the drum and the lowest position of the elevator.

42. An apparatus according to claim 41, wherein the sliding device is in the form of a sliding gripper activatable by a controlled operating jack or the like.

43. An apparatus according to claim 42, wherein the sliding device is slide retractable into the drum.

44. An apparatus according to claim 43, wherein the magazine and cellular panel charger are located on a mobile trolley.

* * * * *